United States Patent [19]

Abendroth

[11] 4,366,028

[45] Dec. 28, 1982

[54] JAMB BRICK SUPPORT FOR COKE OVEN DOORS

[75] Inventor: Werner Abendroth, Haltern, Fed. Rep. of Germany

[73] Assignee: Firma Carl Still GmbH & Co. K.G., Fed. Rep. of Germany

[21] Appl. No.: 318,991

[22] Filed: Nov. 6, 1981

[30] Foreign Application Priority Data

Nov. 27, 1980 [DE] Fed. Rep. of Germany ..... 3044607

[51] Int. Cl.[3] ..... C10B 25/06; C10B 25/16

[52] U.S. Cl. ..... 202/248; 110/173 R; 202/269

[58] Field of Search ..... 202/248, 269; 110/173 R; 49/483, 485, 495

[56] References Cited

U.S. PATENT DOCUMENTS

| | | | |
|---|---|---|---|
| 1,988,602 | 1/1935 | McIntire | 202/248 |
| 2,157,569 | 5/1939 | Potter | 202/248 |
| 2,183,704 | 12/1939 | Wilputte | 202/248 |
| 2,190,297 | 2/1940 | Salkvist | 202/248 |
| 2,207,562 | 7/1940 | Van Ackeren | 202/248 |

FOREIGN PATENT DOCUMENTS

| | | | |
|---|---|---|---|
| 701545 | 12/1940 | Fed. Rep. of Germany | 202/248 |

*Primary Examiner*—Bradley Garris

*Attorney, Agent, or Firm*—McGlew and Tuttle

[57] ABSTRACT

A jamb brick support for a coke oven door is provided at the bottom of the door body on the side facing the oven chamber and supports at least the lower part of the refractory door stopper and, with the door set in place, extends closely above the oven sole and the oven sole plate of the chamber frame.

7 Claims, 1 Drawing Figure

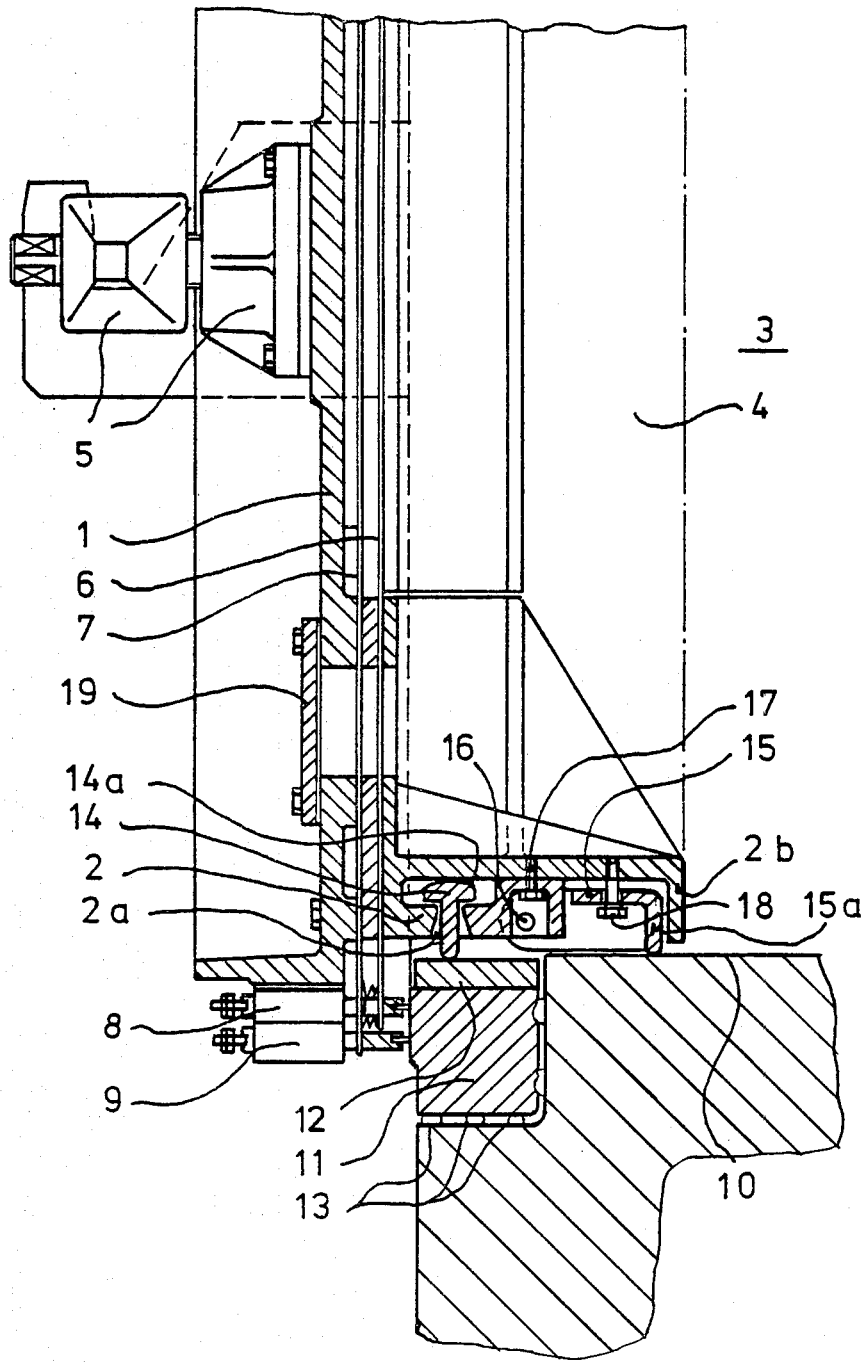
3
4
5
1
6
7
19
17
16
15
14a
14
2
2 b
2 a
18
15a
8
9
12
11
13
10

JAMB BRICK SUPPORT FOR COKE OVEN DOORS

FIELD AND BACKGROUND OF THE INVENTION

The invention relates, in general, to coke ovens and, more particularly, to a new and useful jamb brick support for a coke oven door for closing the opening of a coke oven chamber, the door being of the type having a door body, at the bottom of which is provided the jamb brick support on the side facing the oven chamber, the jamb brick support supporting at least the lower part of the refractory door stopper which extends into the oven chamber closely above the oven sole and the oven sole plate of the chamber frame when the door is set in place.

In accordance with a known technique of installing coke oven doors, the jamb brick support of the door is set onto the oven sole plate of the chamber frame or onto the chamber frame itself. In another known construction, the door is suspended from lateral or central ribs of the chamber frame by means of a plurality of rollers and webs provided on the door body. This leaves, even in the lowered position of the oven door, a floor gap of about twenty-five millimeters or more. Fine coal deposits in the floor gap at every charging of the oven chamber. As soon as such an amount of solid material has deposited below the edge of the jamb brick support, upon which the door rests against in that area alone, a produced tilting moment tends to push the upper part of the door out of the door opening.

In relation to the transfer of the locking forces to the sealing surfaces and, thus to the tightness of the oven door during operation, a number of problems arise in prior constructions.

If the coke oven door bears against the frame at the bottom, the friction grip under the own weight of the door prevents the locking forces introduced in the lower part of the door, from producing their full effect on the sealing blades. The frictional resistance between the jamb brick support and the oven sole plate absorbs up to fifty percent of the locking forces acting on the lower part of the door body. As a result, substantially stronger locking forces must be applied in the lower part of the oven door than in the upper part. In practice, this may require locking devices of different size.

In the so-called suspended coke oven doors, the total weight of the door acts on the door frame asymmetrically. This results in a bending load on the chamber frame, in addition to the thermal load, which requires a heavy construction of the frame to prevent fractures and bending, and thus failures in sealing.

SUMMARY OF THE INVENTION

The invention is directed to an improvement of the design of a jamb brick support of the above mentioned kind, which permits a reduction in the frictional resistance at the oven sole plate and minimization of the other forces acting on the jamb brick support, so as to restrain their effect on the locking forces.

This is obtained, in accordance with the invention, by providing that at the underside of the jamb brick support, approximately below the center of gravity of the oven door, a propping element is provided which is supported for movement in the longitudinal direction of the chamber and which, with the door set in place, resposes on the oven sole plate of the chamber frame or on the chamber frame itself. A particularly advantageous design in this connection is achieved by designing the propping element as a T-section member having a circularly rounded upper surface on its upper T-shape flange and suspending the T-section member in an elongated slot with the elongated slot continually enlarging downwardly within the jamb brick support.

While introducing the oven door into the chamber frame, the T-section member is centered by its own weight and, after the door is set in place, comes to rest against the sole plate below. Due to the circularly rounded upper surface of the flange of the T-section member, upon applying the locking forces, the underside of the jamb brick support can roll on this rounded surface, so that the lower part of the door can move, within certain limits, towards the frame, without having to overcome substantial frictional forces. Consequently, during the entire operating time, the full locking forces are transferred to the sealing surfaces of the chamber frame.

In order to keep the space between the jamb brick support and the oven sole entirely clean also from the charged coal, the invention further provides that spaced from the propping element in the direction of the oven chamber, a flap is provided at the jamb brick support, which is unilaterally hinged to a horizontal hinge pin extending transversely to the longitudinal direction of the chamber so that its free end portion is turned to the oven chamber for suspended movement with this free end portion being angled vertically downwardly. During the insertion of the oven door into the chamber opening, this movable flap, requiring virtually no maintenance, can slide over the oven sole plate, and then applies against the oven sole only slightly, by its own weight. This prevents the charged coal from penetrating below the jam brick support of the oven door now set in place, and the troublesome cleaning is saved.

To protect the inventive flap, it is provided in addition that the downwardly angle end portion of the flap extends behind a downwardly extending leg of the jam brick support which is provided on the end of the jamb brick support adjacent the oven chamber.

This further ensures that the flap remains freely movable and, primarily, that charged coal cannot accumulate between the flap and the jamb brick support.

The inventive jamb brick support carrying the movable propping element and the unilaterally hinged flap is particularly effective when applied to a door sealing system comprising sealing diaphragms and spring biased sealing blades, if the clearance of motion of the door due to the provision of the propping element substantially corresponds to the adjusted working deflection of the springs biasing the sealing blades.

The inventive jamb brick support is applicable independently of the design, or the locking system, of the door, both to suspended and bottom-supported oven door constructions.

Advantageously, almost any existing coke oven door may subsequently be provided with the inventive construction.

Thus, in accordance with the invention there is provided in a coke oven door assembly for closing an opening to an oven chamber of a horizontal coke oven, the door assembly being of the type having a door body, a refractory door member mounted to the door body on a side thereof adjacent the oven chamber and designed to extend into the oven chamber above the oven sole, a jamb brick support mounted at the bottom of the door body on the side adjacent the oven chamber, and at least a lower part of the refractory door member being supported by the jamb brick support, the coke oven having a chamber frame bordering the opening, and wherein in the position in which the opening is closed by the door assembly the jamb brick support is extended closely above the oven sole and the chamber frame, the improvement wherein the jamb brick support comprises a propping member mounted to the underside of the jamb brick support for movement in the longitudinal direction of the coke oven, and wherein, in the position in which the opening closed by the door assembly, the propping member is reposed on the chamber frame for supporting the door assembly.

The propping member is advantageously mounted approximately below the center of gravity of the oven door.

Where a sole plate is mounted on the chamber frame intermediate the jamb brick support and the chamber frame, the propping member is reposed on the sole plate.

In accordance with a preferred embodiment of the invention, propping member is a T-section member, the T-section member has an upper T-flange with a circularly rounded upper surface, the jamb brick support is formed with an elongated slot open along the underside thereof, the slot being continuously enlarged from an inner portion of the jamb brick support to the underside, and the T-section member is suspended in the elongated slot.

In accordance with a further preferred feature of the present invention, a flap is provided intermediate the propping member and the oven chamber and means are provided for hingedly mounting the flap at a first end to the jamb brick support. The flap has a second end formed with an end portion with a leg extending vertically downwardly on the side of the door body adjacent the oven chamber and the annular end portion is slidably mounted on the oven sole.

Thus, it is an object of the invention to provide an improved jamb brick support which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

BRIEF DESCRIPTION OF THE DRAWING

In the Drawing:

The single sole FIGURE illustrating the lower part of a coke oven door set in place in a chamber opening, partly in section.

DETAILED DESCRIPTION

As shown in the FIGURE, a jamb brick support 2, mainly intended to support a refractory door stopper 4, adjacent a coke oven chamber is screwed to the door body 1 on the oven chamber side thereof. In the prior art, such brick supports have been provided with an even underside extending horizontally or slightly sloping upwardly toward the inside of the oven chamber 3. In the inventive jamb brick support, the underside of the support is provided with mounting fixtures for a propping element 14, designed as a T-section member, and with a flap 15 which is mounted to a hinge pin 16 by means of screws 17, 18.

The mounting fixture for the T-section member comprises downwardly projecting retaining elements which are integral with, or screwed to, the jamb brick support 2 and form an elongated slot **2*a*. In the illustrated embodiment, a left hand retaining element for the propping member 14 is integral with the support 2. A right-hand retaining element is screwed to the support 2 and is used, at the same time, for supporting hinge pin 16**.

The operation of the inventive device may be described as follows.

While inserting the oven door into the opening, the T-section member hangs in the elongated slot, with sufficient clearance being left above the upper flange surface thereof. The free end **15*a* of flap 15, illustrated as an angled end-portion reposes on retaining screw 18 and slides on an oven sole 10 in the direction of the oven chamber interior. Then, upon lowering the door, the angled end portion 2*b* or leg of the jamb brick support 2, which extends over the greatest part of flap 15 and the jamb brick support, as well as the entire door, come to bear against the circularly rounded upper flange surface 14*a* of the T-section member. During the motion of the door against the sealing surface of frame 11, the T-section member performs a pivotal motion about its bottom end, and the underside of the jamb brick support 2 proper rolls on the circularly rounded surface 14*a*** of the T-section member.

Thus, in accordance with the invention, a jamb brick support for coke oven doors, which is provided at the bottom of the door body on the side facing the oven chamber and supports at least the lower part of the refractory door stopper and, with the open door set in place, extends closely above the oven sole and the oven sole plate of the chamber frame, is characterized in that at the underside of the jamb brick support 2, approximately below the center of gravity of the oven door, a propping element is provided which is supported for movement in the longitudinal direction of the chamber and which, with the door set in place, reposes on the oven sole plate 12 of the chamber frame 11 or on the chamber frame 11 or on the chamber frame 11 itself.

The propping element is designed as a T-section member 14 having a circularly rounded upper surface **14*a* of its upper T-flange, and being suspended in an elongated slot 2*a*, with the elongated slot 2*a*** continually enlarging downwardly.

The inventive arrangement is further characterized in that, spaced from the propping element 14 in the direction of the oven chamber, a flap 15 is provided at the jamb brick support 2, which is unilaterally hinged to a horizontal hinge pin 16 extending transversely to the longitudinal direction of the chamber, so that its free end portion, turned to the oven chamber, is movably suspended, with this free end portion **15*a*** being angled vertically downwardly.

The inventive arrangement is even still further characterized in that the downwardly angled end portion of the flap 15 extends behind a downwardly extending leg **2*b* of the jamb brick support proper 2**, provided on the end of the latter.

If a door sealing system is employed comprising sealing diaphragms 6,7 and spring biased sealing blades 8,9, it is preferred that the clearance of motion of the door due to the provided propping element 14 approximately corresponds to the adjusted travel stroke of the spring system of the sealing blades.

While specific embodiments of the invention have been shown and described in detail to illustrate the application of the principles of the invention, it will be understood that the invention may be embodied otherwise without departing from such principles.

What is claimed is:

1. In a coke oven door assembly for closing an opening to an oven chamber of a horizontal coke oven, the door assembly being of the type having a door body, a refractory door member mounted to the door body on a side thereof adjacent the oven chamber and designed to extend into the oven chamber above the oven sole, a jamb brick support mounted at the bottom of the door body on the side adjacent the oven chamber, and at least a lower part of the refractory door member being supported by the jamb brick support, the coke oven having a chamber frame bordering the opening, and wherein in the position in which the opening is closed by the door assembly, the jamb brick support is extended closely above the oven sole and the chamber frame, the improvement wherein the jamb brick support comprises a propping member mounted to the underside of the jamb brick support for movement in the longitudinal direction of the coke oven, and wherein, in the position in which the opening is closed by the door assembly, said propping member is reposed at least indirectly on the chamber frame for supporting the door assembly.

2. In a coke oven door assembly as set forth in claim 1, wherein said propping member is mounted approximately below the center of gravity of the oven door assembly.

3. In a coke oven door assembly as set forth in claim 2, further comprising a sole plate mounted on the chamber frame intermediate the jamb brick support and the chamber frame, and wherein said propping member is reposed on said sole plate.

4. In a coke oven door assembly as set forth in claim 1, or 2 or 3, wherein said propping member comprises a T-section member, said T-section member having an upper T-flange with a circularly rounded upper surface, the jamb brick support being formed with an elongated slot open along the underside thereof, said slot being continuously enlarged from an inner portion of the jamb brick support to the underside, and said T-section member being suspended in said elongated slot.

5. In a coke oven door assembly as set forth in claim 4, further comprising a flap intermediate said propping member and the oven chamber, means for hingedly mounting said flap at a first end to the jamb brick support, said flap having a second end formed with an angled end-portion with a leg extending vertically downwardly on the side of the door body adjacent the oven chamber, and said angled end-portion being slidably mounted on the oven sole.

6. In a coke oven door assembly as set forth in claim 5 wherein the jamb brick support includes a downwardly extending leg at an end thereof intermediate said angled end-portion and the oven chamber.

7. In a coke oven door assembly as set forth in claim 5, further comprising a sealing surface bordering the opening, a sealing diaphragm mounted to the door body, sealing blades mounted to said diaphragm, spring means for resiliently biasing the sealing blades through a travel stroke to bear against said sealing surface in sealing engagement, and said door assembly being movable through a clearance, about said propping member and said clearance being approximately equal to said travel stroke.

* * * * *